United States Patent [19]

Nogami et al.

[11] 4,444,861

[45] Apr. 24, 1984

[54] PHOTO SENSITIVE ARTICLE FOR ELECTROPHOTOGRAPHY CONTAINING CHARGE TRANSFER MATERIAL

[75] Inventors: Sumitaka Nogami, Yokohama; Yoshiharu Kitahama, Kawasaki; Isamu Iwami, Zushi, all of Japan

[73] Assignee: Ashai Kasei Kogyo Kabushiki Kaisha, Osaka, Japan

[21] Appl. No.: 448,605

[22] Filed: Dec. 10, 1982

[30] Foreign Application Priority Data

| | | | |
|---|---|---|---|
| Dec. 15, 1981 | [JP] | Japan | 56-201942 |
| Dec. 15, 1981 | [JP] | Japan | 56-201943 |
| Dec. 15, 1981 | [JP] | Japan | 56-201944 |
| Jun. 1, 1982 | [JP] | Japan | 57-92122 |
| Jun. 1, 1982 | [JP] | Japan | 57-92123 |
| Jun. 1, 1982 | [JP] | Japan | 57-92124 |

[51] Int. Cl.[3] ..... G03G 5/07

[52] U.S. Cl. ..... 430/58; 430/72; 430/71; 430/900; 430/76

[58] Field of Search ..... 430/58, 72, 71, 900

[56] References Cited

U.S. PATENT DOCUMENTS

| | | | |
|---|---|---|---|
| 3,884,690 | 5/1975 | Radler | 430/58 |
| 4,281,106 | 7/1981 | Anderson | 528/74 |
| 4,371,690 | 2/1983 | Anderson | 528/176 |

*Primary Examiner*—John D. Welsh

*Attorney, Agent, or Firm*—Armstrong, Nikaido, Marmelstein & Kubovcik

[57] ABSTRACT

An electrophotographic sensitive article comprising an electroconductive substrate and a photoconductive layer formed on said substrate and composed of an electric charge generating substance and an electric charge transfer substance, which sensitive article is characterized by said electric charge transfer substance having as an active component thereof a polyester obtained from a diol component consisting preponderantly of 2,6-dimethoxy-9,10-anthracene diol and a dicarboxylic acid component consisting preponderantly of α,ω-dicarboxylic acid. This electrophotographic sensitive article has remarkable sensitiveness and processability.

17 Claims, 2 Drawing Figures

PHOTO SENSITIVE ARTICLE FOR ELECTROPHOTOGRAPHY CONTAINING CHARGE TRANSFER MATERIAL

BACKGROUND OF THE INVENTION

This invention relates to a novel sensitive article for electrophotography which comprises an electric charge generating substance and an electric charge transfer substance. More particularly, this invention relates to a novel sensitive article for electrophotography which uses a novel polyester as an active component for the electron charge transfer substance.

Heretofore, selenium, cadmium sulfide, zinc sulfide, a-silicon, and selenium-tellurium have been proposed as photoconductive materials for sensitizing articles for electrophotography.

The electrophotography is a process for forming a visible image of given graphic matter by electrifying a sensitive article in a dark place, then exposing the sensitive article to light through the graphic matter thereby selectively discharging electricity from the sensitive article and forming a latent image, and subsequently developing the latent image portion of the sensitive article with a toner. The sensitive article to be used in the electrophotography is required to possess high capacity for electrification in the dark place, admit of only sparing discharge or dark current, and provide quick release of electric charge upon irradiation with light or, in other words, enjoy high sensitivity. As photoconductive materials capable of satisfying all these requirements, numerous inorganic photoconductive materials such as are enumerated above have been accepted for actual use.

In contrast to those inorganic sensitive articles, there have been proposed many electrophotographic sensitive articles which use organic photoconductive materials featuring non pollution, good processability, high flexibility, and light weight.

Owing to the discovery that organic photoconductive materials each formed of a combination of an electric charge generating substance and an electric charge transfer substance possess outstanding properties as sensitive materials, electrophotographic sensitive articles using various organic substances have been proposed. For example, electrophotographic sensitive articles using a combination of poly-N-vinylcarbazole with 2,4,7-trinitro-9-fluorenone (U.S. Pat. No. 3,484,237), a combination of a pyrazoline compound with chlorodianeblue or squanylium (Japanese Patent Application Laid-Open No. 55643/77 and No. 105536/74), a combination having thiapyrylium salt and triphenylmethane dispersed in polycarbonate resin [J. Appl. Phys., 49, 5543 (1978)], and a combination of 9-(4-diethylaminostyryl) anthracene or N-methyl-N-phenylhydrazo-3-methylidene-9-ethylcarbazole with a bis-azo compound (Richo. Tech. Report., 1980(3), 4), etc. have been proposed. Researches are now actively under way as aimed at developing electric charge generating substances and electric charge transfer substances of increasingly high efficiency, completing sensitive structures by optimum combination of such newly developed substances, and improving practical properties of such sensitive articles. As electric charge transfer substances, there have been proposed pyrazoline compounds, 9-(4-diethylaminostyryl) anthracene, N-methyl-N-phenylhydrazo-3-methylidene-9-ethylcarbazole, etc. which are invariably low molecular compounds.

These compounds, however, still have many defects. For example, these compounds have no sufficient stability in their independent form and, for use in a sensitive article, inevitably necessitate additional use of a polymeric binding agent because they are incapable of forming a film unless they are dissolved or dispersed in the binding agent. Since the sensitive article relies for transfer of electric charge upon such an electric charge transfer substance, it is desired to contain the electric charge transfer substance amply. Thus, there is a possibility that the greater part of the sensitive article is accounted for by a low molecular-weight electric charge transfer substance. Consequently, the compatibility of the electric charge transfer substance in the polymeric substance being used as the binding agent, the transparency of the film consequently formed of the electric charge transfer substance dispersed in the binding agent, and the properties of the produced film may pose themselves as problems. The selection of the polymeric binding agent to be additionally used as described above, therefore, demands especial care. When there is adopted a low molecular-weight electric charge transfer substance which by nature lacks compatibility in a polymeric binding agent, the selection of a polymeric substance and the formulation of the electric charge transfer substance with the selected polymeric substance are required to be carried out most attentively lest the transparency and other physical properties of the produced film should be degraded. Despite the great care thus taken, since the low molecular-weight compound in a large amount is dissolved or dispersed in the form of filler in the polymeric substance, the film or coat consequently produced from the resultant combination no longer retains the outstanding flexibility, thermal resistance, and strength possessed inherently by the polymeric substance.

For the elimination of these defects, high molecular-weight electric charge transfer substance is desired to be capable of being converted in its unmodified form into a film or coat.

Because most of the conventional polymeric electric charge transfer substances are not easily mass produced or because they are incapable of being polymerized to sufficiently high molecular weights, only a very few polymeric electric charge transfer substances such as poly-N-vinylcarbazole and halogenated poly-N-vinylcarbazole have been so far demonstrated to fulfil the requirement and prove feasible.

The inventors of the present invention carried out a devoted study in search for a high molecular-weight substance effectively functioning as an electric charge transfer substance for electrophotographic sensitive article and possessing an ample film-forming property. They have consequently found that a polyester obtained from 2,6-dimethoxy-9,10-anthracene diol and an $\alpha,\omega$-dicarboxylic acid constitutes itself an excellent high molecular-weight electric charge transfer substance and effectively functions as an electric charge transfer substance for an electrophotographic sensitive article. The present invention has issued from this discovery.

The inventors formerly found that a polyester obtained from an anthracene diol type compound and a dicarboxylic acid is useful as an organic fluorescent substance or organic semiconductor (Japanese Patent Application No. 172546/80) and also proposed a method for commercial manufacture of this polyester (Japanese Patent Application No. 174717/80). After a further study, the inventors of the present invention have ascertained that a polyester obtained from 2,6-dimethoxy-9,10-anthracene diol and an $\alpha,\omega$-dicarboxylic acid manifests specifically outstanding properties when it is used as an electric charge transfer substance for an electrophotographic sensitive article.

As 9,10-anthracene diol derivatives, various substitution products such as, for example, 2-methoxy-9,10-anthracene diol, 2,3-dimethoxy-9,10-anthracene diol, and 2,7-isopropoxy-9,10-anthracene diol have also been conceived. A comparative study conducted on all these substitution products has revealed that the 2-, 2,3-, and 2,7-substitution products are invariably inferior in properties to the 2,6-dimethoxy substitution product, irrespectively of the kind of substituents involved therein. The reason for their inferiority is still unknown at present. When polyesters are synthesized from these diols and $\alpha,\omega$-dicarboxylic acids, the 2,6-dimethoxy substitution products exhibit high crystallinity and the 2-, 2,3-, and 2,7-substitution products exhibit only low crystallinity. This lower crystallinity may possibly explain why the latter substitution products fail to manifest an ample electric charge transfer activity. Among other substitution products, those using a methoxy group impart the highest levels of sensitivity to the sensitive articles obtained from the corresponding polyesters. A possible reason for the excellent sensitivity may be that the incorporation of a methoxy group will lower the ionization potential and, at the same time, enhance the crystallinity of the polyester of the present invention.

SUMMARY OF THE INVENTION

It is a primary object of the present invention to provide a novel electrophotographic sensitive article, characterized by comprising an electroconductive substrate and a photoconductive layer formed of an electric charge generating substance and an electric charge transfer substance and deposited on the aforementioned conductive substrate, and the aforementioned electric charge transfer substance using as an active component thereof a polyester obtained from a diol component preponderantly composed of 2,6-dimethoxy-9,10-anthracene diol and a dicarboxylic acid component preponderantly composed of $\alpha,\omega$-dicarboxylic acid.

DETAILED DESCRIPTION OF THE INVENTION

Figure 1:
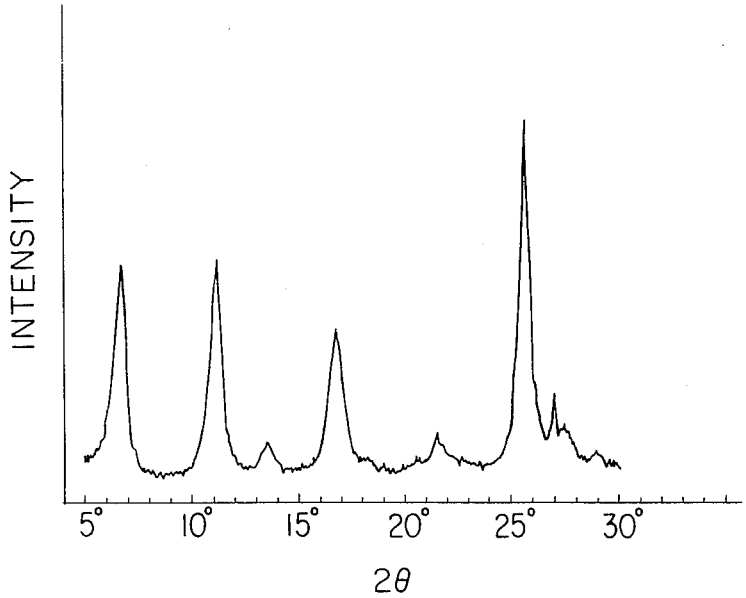
FIG. 1 is the X-ray diffraction pattern of crystalline chloroaluminum phthalocyanine chloride obtained in Example 11.

The polyester of the present invention obtained from 2,6-dimethoxy-9,10-anthracene diol and an $\alpha,\omega$-dicarboxylic acid can be easily produced by the condensation reaction of 2,6-dimethoxy-9,10-anthracene diol or a functional derivative thereof with an $\alpha,\omega$-dicarboxylic acid or a functional derivative thereof. Here, the $\alpha,\omega$-dicarboxylic acid which is used for producing the polyester is preferable to be any of the $\alpha,\omega$-dicarboxylic acids having 8 to 14 carbon atoms. Concrete examples of the acids are 1,6-hexanedicarboxylic acid, 1,7-heptanedicarboxylic acid, 1,9-nonanedicarboxylic acid, 1,10-decanedicarboxylic acid, 1,11-undecanedicarboxylic acid, and 1,12-undecanedicarboxylic acid.

In the production of the polyester, these $\alpha,\omega$-dicarboxylic acids may be used either singly or in the form of a mixture of two or more members. Optionally, not more than 30 mol% of the $\alpha,\omega$-dicarboxylic acid may be substituted with an aromatic dicarboxylic acid such as, for example, isophthalic acid, terephthalic acid, or phthalic acid. It is also permissible to have the same proportion of the $\alpha,\omega$-dicarboxylic acid as mentioned above substituted with an $\alpha,\omega$-dicarboxylic acid having any number of carbon atoms other than 8 through 14 specified above. Examples of such $\alpha,\omega$-dicarboxylic acids are 1,5-pentanedicarboxylic acid, 1,4-butanedicarboxylic acid, 1,15-pentadecanedicarboxylic acid, 1,16-hexadecanedicarboxylic acid, and 1,17-heptadecanedicarboxylic acid.

By thus using two or more $\alpha,\omega$-dicarboxylic acids as suitably mixed, delicate change in physical properties such as, for example, modulus of elasticity and thermal resistance may be imparted to the polyester to be produced. By the same reason, part of the 2,6-dimethoxy-9,10-anthracene diol may be substituted in a desired proportion with some other diol component. Examples of such other diols are 9,10-anthracene diol, 2-dimethylamino-9,10-anthracene diol, 2-alkoxy-9,10-anthracene diols represented by 2-methoxy-9,10-anthracene diol, and 2-ethoxy-9,10-anthracene diol, diols having a phenolic hydroxyl group represented by hydroquinone and bisphenol A, and 2-halogeno-9,10-anthracene diols represented by 2-chloro-9,10-anthracene diol and 2-bromo-9,10-anthracene diol. To prevent the desired properties of the sensitive article of the present invention from being degraded by the addition of such a substitutive diol, the amount of the diol so added is desired to be limited to below 20 mol% of the 2,6-dimethoxy-9,10-anthracene diol.

The polyester which is produced as described above is a crystalline polyester having a melting point between 100° C. and 250° C. It is soluble in such solvents as tetrachloroethane, nitrobenzene, and chloral hydrate. From the solution of the polyester in such a solvent, a light yellow transparent (slightly cloudy at times) film can be produced by subjecting the solution to the solution casting process or by hot-melt press process.

To acquire a film-forming property, the polyester is desired to have a high degree of polymerization. From the standpoint of ease of processing, the inherent viscosity ($\eta_{inh}$) of the polymer is desired to fall in the range of 0.2 to 1.5. Here, the inherent viscosity $$(\eta_{inh}) = \left(\ln \frac{t}{t_o}\right) / C$$

is the value to be obtained by measurement in tetrachloroethane (0.5 g/100 ml) at 25° C.

The polyester of the present invention possesses in itself a good film-forming property and constitutes itself a good electric charge transfer substance and, therefore, calls for no additional incorporation of some other polymeric substance or plasticizer. For the purpose of permitting adjustment of electrifying property, enhancing the resistance to impacts of printing, and improving the film strength, however, the polyester may additionally incorporate therein such additives. Examples of the polymeric substances which are used for these purposes include linear saturated polyester resins, polycarbonate resin, polyamide resin, polyurethane resin, epoxy resin, butyral resin, silicone resin, and acrylic resin.

Examples of the plasticizers similarly usable are dioctyl phthalate, dibutyl phthalate, and terphenyls.

To prevent the desired properties of the electric charge transfer substance from being degraded by the addition of such a polymeric substance and a plasticizer, the total amount in which these compounds are incorporated is desired to be limited to below 40% by weight based on the weight of the electric charge transfer substance.

When the electric charge transfer substance additionally incorporates therein an acceptor such as, for example, an aromatic carboxylic ester, ketone resin, a diallyl phthalate prepolymer, a phthalic ester, a benzoic ester, a trimellitic ester, or a salicyclic ester, it is notably improved in stability to withstand repeating cycles of electrification and exposure to light. Aromatic carboxylic esters and ketone compounds are usable as advantageous compounds of the nature of acceptors. These aromatic carboxylic esters or ketone compounds which are usable as advantageous acceptors include not only those of low molecular weights but also those of medium to high molecular weights which contain, partly in the molecules thereof, aromatic carboxylic ester structures or ketone structures. Concrete examples of such aromatic carboxylic esters are methyl benzoate, dimethyl isophthalate, diethyl terephthalate, dioctyl phthalate, methyl para-hydroxybenzoate, trimellitic acid trimethyl ester, salicyclic acid methyl ester, diallyl phthalate, diallyl isophthalate, poly(ethylene terephthalate), poly(propylene isophthalate), diallyl phthalate prepolymer, and diallyl isophthalate prepolymer. Concrete examples of ketone compounds include acetophenone, benzophenone, cyclohexanone, and ketone resin. Such an additive is incorporated in the electric charge transfer substance in an amount of 5 to 30% by weight based on the weight of the electric charge transfer substance.

The polyester of the present invention is an active component for the polymeric electric charge transfer substance. For use in the electrophotographic sensitive article, this polyester is combined with an electric charge generating substance to form a photoconductive component. The electrophotographic sensitive article of the present invention can be formed by any of the three methods (I) through (III) indicated below.

According to Method (I), the sensitive article is produced by uniformly dispersing an electric charge generating substance in a molecular form within the aforementioned polyester and depositing the resultant dispersion product in the form of a layer on an electroconductive substrate. According to Method (II), the sensitive article is obtained by dispersing the electric charge generating substance in the form of particles in the aforementioned polymer and depositing the resultant dispersion product in the form of a layer on the electroconductive substrate. According to Method (III), the sensitive article is obtained by depositing either the electric charge generating substance or electric charge transfer substance in the form of a layer on the electroconductive substrate and depositing on the formed layer the remainder of the two substances mentioned above again in the form of a layer.

In any one of the above three methods (I) to (III), a protective layer can be formed on the uppermost layer according to demand.

The electric charge generating substance to be used in the sensitive article of Method (I) is an electric charge transfer complex of the aforementioned polyester with a varying Lewis acid. Concrete examples of such complexes are those of said polyester with p-chloranyl, 1,3,5-trinitrobenzene, p-nitrophenol, 1-nitroanthraquinone, 1,5-dinitroanthraquinone, 1,8-dinitroanthraquinone, and 2,4,7-trinitro-9-fluorenone. Various dyes are usable as the electric charge generating substance in the sensitive article of Method (I). Concrete examples of such dyes include triaryl methane dyes such as crystal violet and malachite green, xanthene dyes such as rhodamine B, erythrosine, and rose bengal, thiazine dyes such as methylene blue, cyanine dyes, and pyrylium dyes such as pyrylium salts, thiapyrylium salts, and benzopyrylium salts.

As the electric charge generating substance for use in the sensitive article by Method (II) or Method (III), there can be used any of the known organic pigments. Concrete examples of such organic pigments include azo pigments of mono-azo type, bis-azo type, and tris-azo type, metals and metal oxides such as copper, magnesium, palladium, aluminum, zinc, and vanadium oxide, phthalocyanine type pigments such as phthalocyanine, metal-free phthalocyanine, and halogenated phthalocyanine, perylene type pigments, lake type pigments, azo-lake pigments, thio-indigo type pigments, indigo type pigments, anthraquinone type pigments, quinone type pigments, quinacridone type pigments, oxazine type pigments, dioxazine type pigments, and triphenyl methane type pigments. Further, any of the inorganic electric charge generating substances such as, for example, amorphous silicon, amorphous selenium, tellurium, antimony sulfide, selenium-tellurium alloy, cadmium sulfide, zinc oxide, and zinc sulfide can be similarly used.

Among other electric charge generating substances usable, phthalocyanine type pigments prove to be particularly advantageous. Typical examples of phthalocyanine type pigments are crystalline chloroaluminum phthalocyanine chloride and crystalline oxytitanium phthalocyanine. When a multi-layer electrophotographic sensitive article is produced by using such a phthalocyanine type pigment as an electric charge generating substance, it enjoys outstanding sensitivity to exposure and exhibits high photosensitivity in a wide range of wavelengths. Especially, oxytitanium phthalocyanine has been demonstrated to possess high stability to withstand prolonged repetition of the cycle of electrification and light exposure.

The electric charge generating substance is used in the sensitive article by Method (I) in an amount of 0.1 to 10%, preferably 0.2 to 5%, based on the weight of the whole photoconductive layer. The thickness of the photoconductive layer is suitably selected in the range of 3 to 100$\mu$.

The electric charge generating substance is used in the sensitive article by Method (II) in an amount of 1 to 50%, preferably 2 to 30%, based on the weight of the whole photoconductive layer. The thickness of the photoconductive layer is suitably selected in the range of 3 to 100$\mu$.

As used in the sensitive article by Method (III), the thickness of the layer of the electric charge generating substance is in the range of 0.01 to 20$\mu$, preferably 0.05 to 5$\mu$ and that of the electric charge transfer substance is in the range of 3 to 50$\mu$.

Examples of the electroconductive substrate which can be used in the present invention include plates of such metals as aluminum, copper, and gold, and sheets of plastic film or paper having gold, aluminum, indium oxide, and tin oxide vacuum deposited thereon. Optionally, the electroconductive substrate may be provided with a barrier layer formed of aluminum oxide, tin oxide, or plastic material for the purpose of precluding the otherwise possible degradation of the substrate by the impacts exerted during the repeating cycles of electrification and light exposure.

As the barrier layer, a layer formed by dispersing 3 to 10 parts by weight of zinc oxide in 100 parts by weight of polyvinyl alcohol and depositing the resultant dispersion product in a thickness of not more than 1$\mu$ on the surface of the electroconductive substrate or a layer formed by depositing an alcohol-soluble polyamide in a thickness of not more than 1$\mu$ similarly on the substrate can be used particularly advantageously.

The procedure involved in the preparation of the electrophotographic sensitive article varies from one to another of the methods described above. In the case of Method (I), the procedure comprises dissolving the aforementioned polyester as an electric charge transfer substance in conjunction with the aforementioned electric charge generating substance in a suitable solvent, applying the resultant solution to the surface of the electroconductive substrate, and drying the applied layer of the solution on the substrate.

In the case of Method (II), the procedure comprises adding the electric charge generating substance to a solution of the polyester, thoroughly pulverizing and dispersing the resultant mixture as in a ball mill or planetary mill, for example, applying the resultant dispersion product on the electroconductive substrate, and drying the applied layer on the substrate.

The sensitive article by Method (III) is prepared by the procedure which comprises first vacuum depositing the electric charge generating substance on the electroconductive substrate or finely pulverizing the substance in a suitable organic solvent, applying the resultant dispersion product, optionally through the medium of a small amount of binding agent, to the surface of the substrate, drying the applied layer thereby giving rise to an electric charge generating layer, and superposing a layer of the solution of polyester on the electric charge generating layer, and drying the superposed layer.

When the layer of the electric charge transfer substance is formed on the surface of the electroconductive substrate, the preparation of the sensitive article may be accomplished by reversing the procedure just mentioned. Otherwise, a film of the polyester is formed first and a layer of a metal and a layer of an electric charge generating substance are deposited respectively on the front and rear sides of the polyester film.

The sensitive article produced as described above can have its photosensitive property rated on a testing machine, Model SP428, made by Kawaguchi Electric Co., Ltd. as follows.

A sample sensitive article is first electrified by exposure to corona discharge at 5 kV, then allowed to stand in a dark place until the voltage falls to a stated level, and subsequently irradiated with the light from a tungsten lamp adjusted to give an illumination of 20 luxes on the surface thereof. Then, the time (in seconds) which elapses before the surface potential of the sample decreases to one half of the original level is clocked. The product of the intensity of illumination multiplied by the time, in lux-seconds(1x.sec), is reported as the measure of the sensitivity of the sample. The spectral sensitivity of the sample is determined by measuring the intensity of energy, in $\mu W/cm^2$, of the light separated spectrally into constituent colors, calculating the product ($\mu$Jule/cm$^2$) of the intensity of energy multiplied by the time (seconds) required for the surface potential to decrease to one half of the original level.

The repeating property of the sample is determined by electrifying the sample under the conditions of $-5.5$ kV of potential and 20 m/min. of corona linear velocity, irradiating the electrified sample with a light of 500 luxes for 0.5 second, repeating this procedure at a rate of 2.5 seconds/cycle, and after the last cycle of the procedure, measuring charged potential, residual voltage, and sensitivity. The electrophotographic sensitive article of the present invention possesses high sensitivity and good processability as compared with the conventional sensitive article.

Now, working examples of the invention, comparative experiments, and a referential experiment are cited below for more specific illustration of the present invention.

Wherever "wt%" is mentioned in the working examples, comparative experiments, and referential experiment, it shall be invariably construed as meaning "percent by weight."

Referential Experiment

Synthesis of polyesters consisting preponderantly of 2,6-dimethoxy-9,10-anthracene diol and $\alpha,\omega$-dicarboxylic acids having preponderantly 8 through 14 carbon atoms.

These polyesters were invariably obtained by subjecting a 2,6-dimethoxy-9,10-anthracene diol component and an $\alpha,\omega$-dicarboxylic acid chloride component to interfacial polycondensation. The general procedure and conditions used for the synthesis of these polyesters were shown below and the polyester consequently obtained were as described below. Method for synthesis of polyester. In a flask having an inner volume of 500 ml, 300 ml of distilled water was placed and 1/100 mol of 2,6-dimethoxy-9,10-anthraquinone, 1/10 mol of $Na_2S_2O_4$, NaOH, and 2 g. of Qutamin (produced by Kao Soap Co., Ltd.) were added. Under an atmosphere of nitrogen, the contents of the flask were stirred for two hours at room temperature. In the course of the stirring, the contents were gradually dissolved and the initially yellow liquid changed its color to dark red.

To the resultant liquid, 1.15/100 mol of $\alpha,\omega$-dicarboxylic acid chloride dissolved in advance in 100 ml of tetrachloroethane was added all at once. The mixture was then stirred at a high speed of 3000 to 5000 rpm for about 5 minutes. The stirred mixture was left standing. The tetrachloroethane layer formed in consequence of the standing was separated, washed, and thrown into ethanol for precipitation. The yellow to white polymer thus obtained was washed with hot ethanol and dried.

The solution viscosity of the polymer was determined by dissolving a 50-mg sample of the polymer in 25 ml of tetrachloroethane and testing the solution for inherent viscosity at 25° C. The inherent viscosity calculated in accordance with the following formula was reported as the solution viscosity of the polymer.

$$\eta_{inh} = \left(\ln \frac{t}{t_o}\right) / C$$

wherein, t denotes the time for drop of the solution, $t_o$ the time for drop of tetrachloroethane, and C the concentration of the polymer in gr/dl.

The melting point of the polymer was measured with the Differential Scanning Calorimeter (DSC). The results were as shown in the following table.

| Polymer No. | Quinone component | Dicarboxylic acid component | Melting point (°C.) | $\eta_{inh}$ |
|---|---|---|---|---|
| 1 | 2,6-Dimethoxy-9,10-anthraquinone | 1,4-butanedicarboxylic acid | 300 (decomposition) | 0.4 |
| 2 | 2,6-Dimethoxy-9,10-anthraquinone | 1,7-heptanedicarboxylic acid | 178 | 0.7 |
| 3 | 2,6-Dimethoxy-9,10-anthraquinone | 1,8-octanedicarboxylic acid | 198 | 0.9 |
| 4 | 2,6-Dimethoxy-9,10-anthraquinone | 1,10-decanedicarboxylic acid | 176 | 1.1 |
| 5 | 2,6-Dimethoxy-9,10-anthraquinone | 1,12-dodecanedicarboxylic acid | 154 | 0.5 |
| 6 | 2,6-Dimethoxy-9,10-anthraquinone | 1,10-decanedicarboxylic acid/ isophthalic acid (70 mol %:30 mol %) | 198 | 0.4 |
| 7 | 2,6-Dimethoxy-9,10-anthraquinone | 1,8-octanedicarboxylic acid/ 1,12-dodecanedicarboxylic acid (50 mol %:50 mol %) | 160 | 0.3 |
| 8 | 2,6-Dimethoxy-9,10-anthraquinone, with 10 mol % thereof substituted with 9,10-anthraquinone | 1,10-decanedicarboxylic acid | 163 | 0.5 |
| 9 | 2,6-Dimethoxy-9,10-anthraquinone, with 10 mol % thereof substituted with hydroquinone | 1,12-dodecanedicarboxylic acid | 150–160 | 0.7 |
| 10 | 2,6-Dimethoxy-9,10-anthraquinone, with 10 mol % thereof substituted with Bis-phenol A | 1,8-octanedicarboxylic acid | 180–190 | 0.9 |
| 11 | 2,6-Dimethoxy-9,10-anthraquinone, with 20 mol % thereof substituted with hydroquinone | 1,9-nonanedicarboxylic acid | 130–135 | 0.5 |
| 12 | 2,6-Dimethoxy-9,10-anthraquinone | 1,11-undecanedicarboxylic acid | 152 | 0.6 |
| 13 | 2,6-Dimethoxy-9,10-anthraquinone | 1,12-dodecanedicarboxylic acid | 162 | 0.5 |
| 14 | 2,6-Dimethoxy-9,10-anthraquinone | 1,14-tetradecanedicarboxylic acid | 150 | 0.5 |

Example 1

To the surface of an aluminum sheet 100μ in thickness, a solution prepared by thoroughly mixing 100 parts by weight of the polymer, No. 2 of Referential Experiment, with 100 parts by weight of TNF (2,4,7-trinitro-9-fluorenone) and 1800 parts by weight of tetrachloroethane was applied. The applied layer of the solution was dried at 80° C. to produce a film 30μ in thickness. This film was found to possess 500 V of initial charged voltage and 10.0 1×·sec of sensitivity.

Example 2

On the same aluminum sheet as used in Example 1, the procedure of Example 1 was repeated, except that the polymer, No. 6 of Referential Experiment, was used instead. The film consequently produced was found to possess 700 V of initial charged voltage and 19.5 1×·sec of sensitivity.

Examples 3–6

One part by weight of copper phthalocyanine (produced by Toyo Ink Co., Ltd. and marketed under trademark designation of Rionol ES) and 10 parts by weight of a varying polymer (No. 2, 3, 6, and 8) were suspended in tetrachloroethane to produce a 10 wt% suspension. The resultant suspension was thoroughly kneaded in a ball mill and applied in a thickness of 20μ on a polyester film having aluminum vacuum deposited thereon in advance. The applied layer of the suspension was then dried. The relation between the polymer (No.) and the sensitivity of the produced film is shown in Table 1 below.

TABLE 1

| Example | Polymer No. | Initial charged voltage (V) | Sensitivity (lx · sec) |
|---|---|---|---|
| 3 | 2 | 450 | 11 |
| 4 | 3 | 400 | 10 |
| 5 | 8 | 500 | 15 |
| 6 | 6 | 550 | 19 |

Example 7

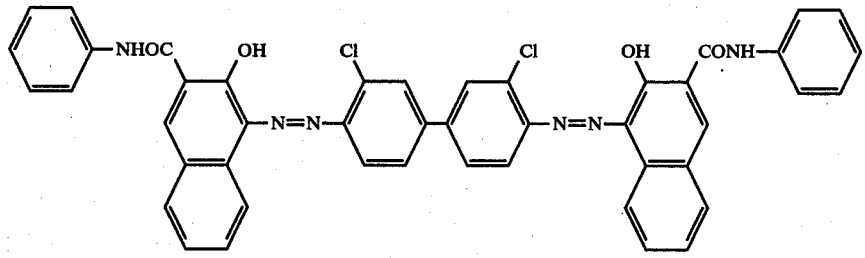

Chlorodianeblue represented by the formula given above was added in a concentration of 1 wt% to tetrachloroethane and kneaded in a ball mill. The resultant solution was applied to the surface of an aluminum sheet 100μ in thickness and dried to produce an electric charge generating film 2.5μ in thickness. On this film, a 10 wt% solution of a varying polymer (No. 2, 10, and 11 of Referential Experiment) in tetrachloroethane was applied and dried to produce a film 30μ in thickness. Sensitivities of the sensitive articles thus produced were found to be 9.0, 12, and 12 1×·sec respectively.

Example 8

Selenium was vacuum deposited in a thickness of about 0.1μ on the surface of an aluminum sheet 100μ in thickness. On the coat of selenium, the polymer (No. 3, 5) was superposed in a thickness of 20μ. The sensitive articles consequently produced were found to possess 700 volts and 650 volts of initial charged voltage and 8.0 1×·sec and 7.5 1×·sec of sensitivity respectively.

Example 9

To the surface of an aluminum sheet 100μ in thickness, a dispersion obtained by crushing 1 part by weight of ε-type copper phthalocyanine (produced by Toyo Ink Co., Ltd. and marketed under trademark designation of Rionolblue ER) in 100 parts by weight of dichloroethane for 48 hours in a ball mill was applied. The applied layer of the dispersion was dried to afford a thin film 0.3μ in thickness. To the phthalocyanine layer thus produced, a homogeneous solution obtained by dissolving 8 parts by weight of the polymer, No. 4 of Referential Experiment, and 2 parts by weight of ketone resin (produced by Hitachi Chemical Co., Ltd. and marketed under trademark designation of Hilac 111) in 100 parts by weight of trichloropropane at 90° C. was applied so as to produce, on being dried, a solid film 15μ in thickness. For comparison, a solution was prepared similarly to the solution mentioned above except for omission of the addition of the ketone resin and applied to the same phthalocyanine layer as described above to form a film 15μ in thickness and complete a sensitive article. The properties of the sensitive articles were as shown in Table 2.

TABLE 2

| | Initial properties | | | Properties after 10,000 repeated cycles | | |
|---|---|---|---|---|---|---|
| | $V_O$ | $V_R$ | $E_{\frac{1}{2}}$ | $V_O'$ | $V_R'$ | $E'_{\frac{1}{2}}$ |
| Working example | 650 | 100 | 15 | 650 | 100 | 15 |
| Comparative experiment | 600 | 78 | 13 | 300 | 50 | 27 |

$V_O$, $V_O'$ — Charged potential (volt)
$V_R$, $V_R'$ — Residual voltage (volt)
$E_{\frac{1}{2}}$, $E'_{\frac{1}{2}}$ — Half exposure sensitivity (lx · sec)

Example 10

The procedure of Example 9 was repeated, except that a varying compound indicated in Table 3 below was used in the place of the ketone resin in the preparation of the solution. The sensitive articles consequently produced were tested for properties. The results were as shown in Table 3.

TABLE 3

| | Initial properties | | | Properties after 10,000 repeated cycles | | |
|---|---|---|---|---|---|---|
| Compound | $V_O$ | $V_R$ | $E_{\frac{1}{2}}$ | $V_O'$ | $V_R'$ | $E'_{\frac{1}{2}}$ |
| Methyl benzoate | 620 | 110 | 18 | 550 | 90 | 22 |
| Dioctyl phthalate | 680 | 90 | 15 | 600 | 85 | 21 |
| Diallyl iso-phthalate | 700 | 120 | 12 | 650 | 110 | 12 |
| Acetophenone | 710 | 135 | 16 | 610 | 60 | 19 |
| Benzophenone | 780 | 160 | 17 | 700 | 100 | 21 |
| Cyclohexane | 700 | 115 | 10 | 600 | 95 | 19 |
| Diallyl phthalate | 680 | 75 | 13 | 630 | 110 | 13 |
| None | 600 | 78 | 13 | 300 | 50 | 27 |

$V_O$, $V_O'$ — Charged potential (volt)
$V_R$, $V_R'$ — Residual voltage (volt)
$E_{\frac{1}{2}}$, $E'_{\frac{1}{2}}$ — Half exposure sensitivity (lx · sec)

Example 11

For the purpose of producing an electric charge generating agent from a mixture of chloroaluminum phthalocyanine chloride represented by the formula, $AlCl_{32}N_8H_{(15.6-14.1)}Cl_{(0.4-1.6)}$ the mixture in the form of powder was pulverized under toluene, xylene, or dichloroethane in a ball mill or the mixture in the form of a vacuum deposited film was immersed in xylene, dichloroethane, tetrachloroethane, or trichloropropane. Consequently, there was obtained crystalline chloroaluminum phthalocyanine chloride, which on being exposed to the radiation of $CuK_\alpha$ having $\lambda=1.5418$ A.U. produced a diffraction pattern (Bragg angle $2\theta\pm0.2$ degrees) showing strong diffraction peaks at 6.7 degrees, 11.2 degrees, 16.7 degrees, and 25.6 degrees as shown in FIG. 1.

The crystalline chloroaluminum phthalocyanine chloride obtained as described above could be vacuum deposited film and used as an electric charge generating layer. Otherwise, when the mixture of chloroaluminum phthalocyanine chloride was finely pulverized in a ball mill, the powdered mixture was dissolved, either all by itself or in combination with a binding agent such as acrylic resin, styrene resin, polyester resin, polyamide resin, polycarbonate resin, or polyvinyl alcohol, in a solvent to produce a dispersion which could be converted into an electric charge generating layer by application to a substrate. In this case, the amount of the binding agent to be used in the preparation of the dispersion was in the range of 20 to 200 parts by weight per 100 parts by weight of chloroaluminum phthalocyanine chloride, although the amount is not specifically defined by this invention. The thickness of the electric charge generating layer was in the range of 200 to 1000 Angstrom(A) when the layer was produced by vacuum deposition or in the range of 0.02 to 5μ (dry film) when the layer was produced by application to a substrate.

Preparation of photoconductive article

In a ball mill, 5 parts by weight of zinc oxide (made by Kasei Optonix) and 95 parts by weight of polyvinyl alcohol (86% of saponification degree) were thoroughly dispersed in a combined concentration of 1 wt% in water. The dispersion product thus obtained was applied to the surface of an aluminum sheet 100μ in thickness. The applied layer of the dispersion on the aluminum sheet was left standing a whole day and night at 50° C. under a vacuum to produce a dry film 1μ in thickness. On this film, chloroaluminum phthalocyanine chloride of the formula, $AlClC_{32}N_8H_{15.4}Cl_{0.6}$, was vacuum deposited under pressure of $10^{-5}$ Torr, to produce a vacuum deposited film 400 A in thickness. The vacuum deposited film was kept immersed in toluene for five minutes to complete crystallization.

To the vacuum deposited film, a homogeneous solution obtained by heating 80 parts by weight of the polymer, No. 4 of Referential Experiment, and 20 parts by weight of polycarbonate (produced by Mitsubishi Gas Chemical Co., Ltd. and marketed under trademark designation of Iupilon S 2000) in 700 parts by weight of trichloropropane at 90° C. was applied so as to give a dry film 15μ in thickness. The photoconductive article thus produced was thoroughly dried under vacuum and then tested for properties. The results were as shown in Table 4 below.

TABLE 4

| Properties | Initial properties | Properties after 5000 repeated cycles | Properties after 10000 repeated cycles | Properties after 20000 repeated cycles | Properties after 30000 repeated cycles |
|---|---|---|---|---|---|
| Surface charged potential (volt) | 600 | 600 | 590 | 580 | 570 |
| Residual potential (volt) | 100 | 100 | 100 | 80 | 80 |
| Half exposure sensitivity to white light (lx · sec) | 2.5 | 2.4 | 2.1 | 2.0 | 2.0 |
| 800 nm Energy sensitivity ($\mu J/cm^2$) | 0.5 | 0.6 | 0.4 | 0.4 | 0.4 |

Example 12

The procedure of Example 11 was repeated, except that copolyamide (produced by Toray, Ltd. and marketed under trademark designation of CM 8000) was used in the place of the dispersion of zinc oxide in polyvinyl alcohol to produce a dry barrier layer 0.8μ in thickness and complete a sensitive article. For comparison, a similar sensitive article was prepared, except for omission of the copolyamide layer. The sensitive articles were tested for properties. The results were as shown in Table 5 below.

TABLE 5

| | Properties | Initial properites | Properties after 10000 repeated cycles | Properties after 20000 repeated cycles | Properties after 30000 repeated cycles | Properties after 40000 repeated cycles |
|---|---|---|---|---|---|---|
| Working Example | Surface charged potential (volt) | 630 | 620 | 600 | 600 | 600 |
| | Residual potential (volt) | 110 | 100 | 100 | 90 | 85 |
| | Half exposure sensitivity to white light (lx · sec) | 2.5 | 2.5 | 2.4 | 2.6 | 2.6 |
| Comparative Experiment | Surface charged potential (volt) | 400 | 100 | — | — | — |
| | Residual potential (volt) | 60 | 30 | — | — | — |
| | Half exposure sensitivity to white light (lx · sec) | 2.4 | 4.0 | — | — | — |

Example 13

The procedure of Example 12 was repeated, except that in the place of the vacuum deposited film of chloroaluminum phthalocyanine chloride, a dispersion obtained by pulverizing and dispersing 6 parts by weight of chloroaluminum phthalocyanine chloride, $AlClC_{32}N_8H_{14.4}Cl_{1.6}$ in 1000 parts by weight of chloroform a whole day and night in a ball mill was applied to produce an electric charge generating layer 700 A in thickness and complete a sensitive article. The sensitive article was tested for properties. The results were as follows.

| | |
|---|---|
| Surface charged potential | 500 volts |
| Residual potential | 70 volts |
| Energy sensitivity at 800 nm | 0.56 $\mu J/cm^2$ |

After 30,000 repeated cycles, the sensitive article showed the following properties.

| | |
|---|---|
| Surface charged potential | 450 volts |
| Residual potential | 50 volts |
| Energy sensitivity at 800 nm | 0.7 $\mu J/cm^2$ |

Example 14

The procedure of Example 13 was repeated, except that a dispersion obtained by dissolving 10 parts by weight of chloroaluminum phthalocyanine chloride, $AlClC_{32}N_8H_{15}Cl$, and 5 parts by weight of polycarbonate (produced by Mitsubishi Gas Chemical Co., Ltd. and marketed under trademark designation of Iupilon E 2000) in 100 parts by weight of dichloroethane and dispersing the solution a whole day and night in a ball mill was applied to a substrate to produce an electric charge generating layer 0.5μ in thickness and complete a sensitive article. The sensitive article showed the following properties.

| | |
|---|---|
| Surface charged potential | 560 volts |
| Residual potential | 110 volts |

-continued

| | |
|---|---|
| Energy sensitivity at 800 nm | 0.8 $\mu J/cm^2$ |

After 30000 repeated cycles, the sensitive article showed the following properties.

| | |
|---|---|
| Surface charged potential | 500 volts |
| Residual potential | 120 volts |
| Energy sensitivity at 800 nm | 0.9 $\mu J/cm^2$ |

Example 15

The procedure of Example 12 was repeated, except that in the place of the polyester obtained from 2,6-dimethoxy-9,10-anthracene diol and 1,10-decanedicarboxylic acid and used in Example 11, there was used a polyester which was obtained from a mixture consisting of 2,6-dimethoxy-9,10-anthracene diol having 20 mol% thereof substituted with 9,10-anthracene diol and, 1,10-decanedicarboxylic acid having 50 mol% thereof substituted with 1,8-octanedicarboxylic acid. The sensitive article consequently produced showed the following properties.

| | |
|---|---|
| Surface charged potential | 700 volts |
| Residual potential | 150 volts |
| Sensitivity to white light | 3.5 lx · sec |

After 20,000 repeated cycles, the sensitive article showed the following properties.

| | |
|---|---|
| Surface charged potential | 650 volts |
| Residual potential | 180 volts |
| Sensitivity to white light | 4.0 lx · sec |

Example 16

The procedure of Example 11 was repeated, except that the thickness of the layer of chloroaluminum phthalocyanine chloride obtained in Example 11 was changed to 800 A and a part of the polymer, No. 4 of Referential Experiment, was substituted by polycarbonate (produced by Mitsubishi Gas Chemical Co., Ltd. and marketed under trademark designation of Iupilon S 2000).

The relation between the amount of polycarbonate used (in wt%) and the properties of the sensitive article produced was as shown below.

TABLE 6

| Amount of substitution (%) | Initial charged potential (V) | Sensitivity (lx · sec) |
|---|---|---|
| 5 | 350 | 0.7 |
| 10 | 400 | 0.8 |
| 20 | 500 | 1.0 |
| 40 | 800 | 7.0 |

Example 17

Figure 2:
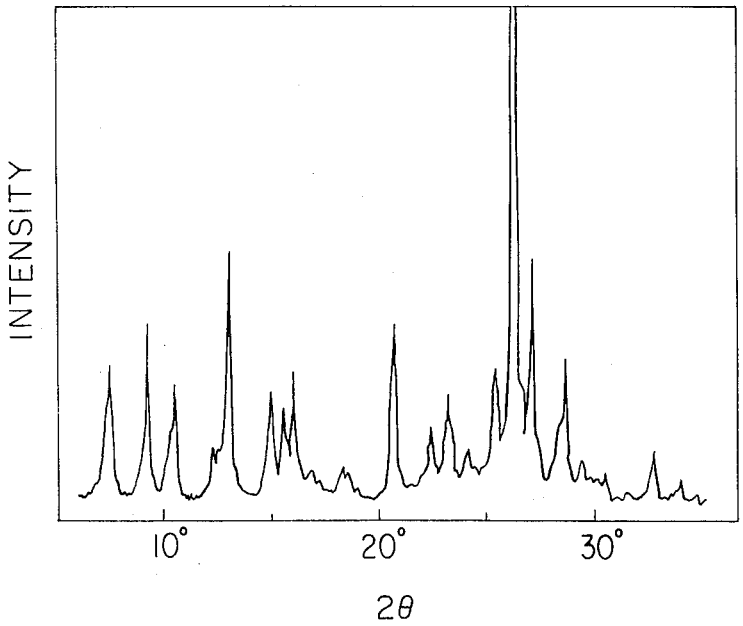
FIG. 2 is the X-ray diffraction pattern of the crystalline oxytitanium phthalocyanine obtained in Example 17.

On the surface of an aluminum sheet 100$\mu$ in thickness, oxytitanium phthalocyanine was vacuum deposited under $10^{-5}$ Torr in a thickness of 0.1$\mu$. The vacuum deposited membrane thus produced was kept immersed in trichloropropane for five minutes. In consequence of this treatment, there was obtained a crystalline membrane which, under the radiation of $CuK_\alpha$ having $\lambda=1.5418$ A.U., gave a diffraction pattern (Bragg angle $2\theta\pm0.2$ degrees) showing strong peaks at 9.2 degrees, 13.1 degrees, 20.7 degrees, 26.2 degrees, and 27.1 degrees as shown in FIG. 2. The same crystalline membrane was similarly obtained by treating the vacuum deposited membrane with other solvents such as, for example, toluene, xylene, chloroform, dichloroethane, and trichloropropane. These results indicate that the amorphous oxytitanium phthalocyanine obtained by vacuum deposition could be efficiently crystallized by treatment in the aforementioned solvent.

Powdered oxytitanium phthalocyanine could be advantageously crystallized when it was pulverized under the aforementioned solvent in a ball mill.

Preparation of photoconductive article

The vacuum deposited membrane prepared as described above was kept immersed in trichloropropane for five minutes to complete crystallization. To the completely crystallized vacuum deposited film, a homogeneous solution obtained by heating 45 parts by weight of the polymer, No. 4 of Referential Experiment, and 955 parts by weight of trichloropropane at 90° C. was applied so as to produce a dry film 15$\mu$ in thickness. The photoconductive article thus produced showed the following properties in Table 7.

TABLE 7

| Properties | Initial properties | Properties after 10000 repeated cycles | Properties after 20000 repeated cycles | Properties after 30000 repeated cycles | Properties after 40000 repeated cycles |
|---|---|---|---|---|---|
| Surface charged potential (volt) | 530 | 510 | 500 | 500 | 500 |
| Residual potential (volt) | 100 | 90 | 90 | 80 | 80 |
| Half exposure sensitivity to white light (lx · sec) | 1.5 | 1.6 | 1.7 | 1.7 | 1.7 |
| 800 nm Energy sensitivity ($\mu J/cm^2$) | 0.4 | 0.5 | 0.5 | 0.5 | 0.5 |

Example 18

The procedure of Example 17 was repeated, except that in the place of the vacuum deposited membrane, there was formed an electric charge generating layer 0.1$\mu$ in thickness by pulverizing 1 part by weight of oxytitanium phthalocyanine in 200 parts by weight of chloroform a whole day and night in a ball mill, to complete a sensitive article. This sensitive article showed the following properties in Table 8.

TABLE 8

| Properties | Initial properties | Properties after 10000 repeated cycles | Properties after 20000 repeated cycles | Properties after 30000 repeated cycles | Properties after 40000 repeated cycles |
|---|---|---|---|---|---|
| Surface charged potential (volt) | 460 | 440 | 440 | 430 | 430 |
| Residual potential (volt) | 120 | 120 | 120 | 100 | 100 |
| Half exposure sensitivity to white light (lx · sec) | 2.2 | 2.4 | 2.4 | 2.3 | 2.5 |
| 800 nm Energy sensitivity ($\mu J/cm^2$) | 0.7 | 0.7 | 0.6 | 0.7 | 0.7 |

What is claimed is:

1. An electrophotographic sensitive article, comprising an electroconductive substrate and a photoconductive layer formed on said substrate and composed of an electric charge generating substance and an electric charge transfer substance, which sensitive article is characterized by said electric charge transfer substance having as an active component thereof a polyester obtained from a diol component consisting preponderantly of 2,6-dimethoxy-9,10-anthracene diol and a dicarboxylic acid component consisting preponderantly of $\alpha,\omega$-dicarboxylic acid.

2. An electrophotographic sensitive article according to claim 1, wherein said polyester has an inherent viscosity in the range of 0.2 to 1.5.

3. An electrophotographic sensitive article according to claim 1, wherein said polyester is a crystalline polyester having a melting point in the range of 100° C. to 250° C.

4. An electrophotographic sensitive article according to claim 1, wherein said electric charge transfer substance contains at least 60% by weight of said polyester and not more than 40% by weight of a polymeric substance or a plasticizer.

5. An electrophotographic sensitive article according to claim 4, wherein said polymeric substance is at least one member selected from the group consisting of linear saturated polyester resin, polycarbonate resin, polyamide resin, polyurethane resin, epoxy resin, butyral resin, and silicone resin.

6. An electrophotographic sensitive article according to claim 4, wherein said plasticizer is at least one member selected from the group consisting of dioctyl phthalate, dibutyl phthalate, and terphenyl.

7. An electrophotographic sensitive article according to claim 1, wherein said electric charge transfer substance contains an aromatic carboxylic ester or ketone compound.

8. An electrophotographic sensitive article according to claim 1, wherein said electric charge generating substance accounts for 0.1 to 50% of the total weight of said photoconductive layer.

9. An electrophotographic sensitive article according to claim 1, wherein said photoconductive layer has a thickness in the range of 3 to 100$\mu$.

10. An electrophotographic sensitive article according to claim 1, wherein the layer containing said electric charge transfer substance has a thickness in the range of 3 to 50$\mu$ and the layer of said electric charge generating substance has a thickness in the range of 0.01 to 20$\mu$.

11. An electrophotographic sensitive article according to claim 1, wherein said electric charge generating substance has as its active component crystalline chloroaluminum phthalocyanine chloride represented by the formula, $AlC_{32}N_8H_{(15.6-14.4)}Cl_{(1.4-2.6)}$.

12. An electrophotographic sensitive article according to claim 1, wherein said electric charge generating substance has as its active component crystalline oxytitanium phthalocyanine.

13. An electrophotographic sensitive article according to claim 12, wherein said electric charge generating substance has as its active component crystalline oxytitanium phthalocyanine and a layer of said electric charge generating substance and a layer of said electric charge transfer substance are superposed in the order mentioned on said electroconductive substrate.

14. An electrophotographic sensitive article according to claim 11, wherein said electric charge generating substance has as its active component crystalline chloroaluminum phthalocyanine chloride and a layer of said electric charge generating substance and a layer of said electric charge transfer substance are superposed in the order mentioned on said electroconductive substrate.

15. An electrophotographic sensitive article according to claim 1, wherein a barrier layer is additionally incorporated in said electrophotographic article and said barrier layer, a layer of said electric charge generating substance, and a layer of said electric charge transfer substance are superposed in the order mentioned on said electroconductive substrate.

16. An electrophotographic sensitive article according to claim 15, wherein said barrier layer is a layer of zinc oxide formed by using polyvinyl alcohol as a binder thereof or a layer formed by application of an alcohol-soluble polyamide and said barrier layer, said electric charge generating layer, and said electric charge transfer layer are superposed in the order mentioned on said electroconductive substrate.

17. An electrophotographic sensitive article according to claim 1, wherein said electroconductive substrate is made of at least one member selected from the group consisting of aluminum, copper, gold, indium oxide, and tin oxide.

* * * * *